US006640505B1

(12) United States Patent
Heierli

(10) Patent No.: US 6,640,505 B1
(45) Date of Patent: Nov. 4, 2003

(54) HYBRID ARCHED OVERFILLED STRUCTURE

(75) Inventor: Werner Heierli, Zurich (CH)

(73) Assignee: BEBOTech Corporation, Middletown, OH (US)

( * ) Notice: Subject to any disclaimer, the term of this patent is extended or adjusted under 35 U.S.C. 154(b) by 1 day.

(21) Appl. No.: 09/983,561

(22) Filed: Oct. 25, 2001

(51) Int. Cl.[7] ..... E04B 7/02; E04B 1/32

(52) U.S. Cl. ..... 52/86; 52/89; 52/169.14; 52/245; 52/259; 52/294; 52/292

(58) Field of Search ..... 52/86, 87, 89, 52/169.14, 245, 259, 294, 292

(56) References Cited

U.S. PATENT DOCUMENTS 2,372,187 A * 3/1945 Davison ..... 52/86
4,558,969 A * 12/1985 FitzSimons ..... 405/124
5,281,053 A * 1/1994 Matiere ..... 405/149
6,161,342 A * 12/2000 Barbier et al. ..... 52/86
6,205,717 B1 * 3/2001 Shall et al. ..... 52/89
6,406,220 B1 * 6/2002 Thomson ..... 405/132
6,408,581 B2 * 6/2002 Monachino ..... 52/247
6,425,213 B1 * 7/2002 Lachapelle ..... 52/169.14

* cited by examiner

*Primary Examiner*—Jeanette Chapman
(74) *Attorney, Agent, or Firm*—Thompson Hine LLP

(57) ABSTRACT

A hybrid arched overfilled structure includes a combination of pre-cast side elements and at least one cast-in-place crown sector element. The side elements are pre-cast generally in a horizontal orientation and subsequently lifted into place. The crown sector element is cast in place between the side elements. In one form of the invention, each of the three sections makes up about one-third of the overall arch span.

23 Claims, 8 Drawing Sheets

HYBRID ARCHED OVERFILLED STRUCTURE

TECHNICAL FIELD OF THE INVENTION

The present invention relates to the general art of geotechnical engineering, and to the particular field of overfilled arch structures.

BACKGROUND OF THE INVENTION

Frequently, overfilled bridges formed of precast or cast-in-place concrete are used to support one pathway over a second pathway, which can be a waterway, a traffic route or the like. The terms "overfilled arch" or "overfilled bridge" will be understood from the teaching of the present disclosure, but in general, an overfilled bridge or an overfilled arch is a bridge formed of arch elements that rest on the ground or on a foundation and has soil or the like resting thereon and thereabout to support and stabilize the bridge. The arch form is generally cylindrical in circumferential shape, and in particular a prolate shape; however, other shapes can be used. An example of an overfilled bridge is disclosed in U.S. Pat. Nos. 3,482,406 and 4,458,457, the disclosures of which are incorporated herein by reference.

Presently, reinforced concrete overfilled arches are usually constructed by one of two methods. The first method includes completing the entire arch structure in place, with formwork used to create the arch profile. This method generally requires formwork on both the inside and the outside of the arch profile as the sides of the arch are generally too steep to be cast without the support provided by formwork. Formwork on the outside of the arch may generally be omitted at the apex of the arch where the gradient of the arch shell is less than about 20° to 30° from horizontal. The provision of such outside form work is both costly and time consuming and may reduce the finished quality of the formed concrete. Furthermore if outside formwork is used, there are restrictions on the thickness of the vault, such as to ensure good qulity concrete the arch vault cannot be less than roughly one foot thick.

A second common method of constructing reinforced concrete overfilled arches is to pre-cast the complete arch or arch halves in sections (elements) and to subsequently place the pre-cast elements onto prepared footings. An example of this type of construction method is disclosed in U.S. Pat. No. 3,482,406. This construction method requires construction of re-usable molds and the transport and lifting of the finished arch profiles into their permanent locations. The aforementioned re-usable mounds are a significant initial investment. This renders this method of construction uneconomical if the molds cannot be re-used to supply elements for the construction of many arch bridges. Investment in such molds is therefore made by pre-casting manufacturers and the arch elements are produced in their factories and transported to the bridge construction site. Problems associated with the transport of such arches and the requirement of a construction crane large enough to lift complete arch elements are disadvantages of this method.

Furthermore, transporting large pre-cast structures may involve complex and expensive transportation problems. Roadways, permits, escorts and clearance requirements must be accounted for, as well as traffic problems and schedules. Still further, in some constructions, very large cranes are required which further exacerbates all of the above-mentioned problems.

Therefore, there is a need for an economical and efficient overfilled bridge and method of constructing an overfilled bridge.

Pre-cast structures are not as versatile as possible, especially if unusual terrain or specifications are present. In particular, precast structures are limited in the forms of curtailment which can be applied at the ends of the bridge. Therefore, there is a need for an overfilled bridge and method of constructing an overfilled bridge that is versatile and amendable to design variations.

OBJECTS OF THE INVENTION

It is a main object of the present invention to provide an economical and efficient bridge structure and method of forming an arched overfilled bridge structure.

It is another object of the present invention to provide a reinforced concrete arch bridge that can be constructed completely on the construction site.

It is another object of the present invention to provide an overfilled arched bridge and method of construction therefor which incorporates small pre-cast components.

It is another object of the present invention to provide an overfilled arched bridge and method of construction therefor which is amenable to including various arch profiles and shapes.

It is another object of the present invention to provide an overfilled arched bridge and method of construction therfor which is more versatile with respect to the formable geometry at the ends of the arched bridge.

It is another object of the present invention to provide an overfilled arched bridge and method of construction therefor which is flexible and versatile and amenable to design variations.

It is another object of the present invention to provide an overfilled arched bridge and method of construction therefor which is amenable to including various arch profiles using the same formwork.

It is another object of the present invention to provide an overfilled arched bridge and method of construction therefor which reduces dependence on large element transportation.

It is another object of the present invention to provide an overfilled arched bridge and method of construction therefor which reduces initial capital investment required.

It is another object of the present invention to provide an overfilled arched bridge and method of construction therefor which is expeditious to produce.

SUMMARY OF THE INVENTION

These, and other, objects are achieved by a hybrid arched overfilled bridge structure and method for constructing the same which combines pre-cast elements with cast-in-place sections. The hybrid bridge thus realizes the advantages associated with precast elements and with cast-in-place elements while omitting most, if not all, of the disadvantages associated therewith. The pre-cast elements can be small and thus will avoid the aforediscussed transportation-related costs and problems, and the cast-in-place sections will avoid the above-discussed formwork problems. The hybrid bridge embodying the present invention thus takes advantage of both methods of construction while avoiding most, if not all, the problems associated with each of the methods of construction.

Furthermore, since the pre-cast side elements make up a shorter sector of the arch than is the case with prior bridges, it is possible to pre-cast them lying flat (that is, comparable to a curved slab) rather than vertical (comparable to a curved wall). This makes casting simpler and cheaper than prior methods and the required forms are much cheaper than the forms required by prior methods. Furthermore, as compared to prior methods of construction of overfilled bridges, it is more feasible to perform the side element casting operation locally on the construction site at which the arch is being built using the pre-cast side elements of the present invention.

Still further, the pre-cast components of the present invention are lighter, less unwieldy and easier to work with than prior elements and thus are easier to cast, stock, transport, unload and erect than prior bridge components.

Still further, since the upper part of the bridge structure (the crown sector) is cast in place, it can be continuous and thus the distribution of loads on the structure will be enhanced by shell action. Trimming the ends (battered ends) along the plane of the embankment is much simpler with the bridge structure of the present invention than with prior bridge structures where both spandral and wing walls were required. Because the crown sector of the present invention is cast in place, it will be less costly than prior bridge structures, yet will still be high quality and have a desired aesthetic appearance.

BRIEF DESCRIPTION OF THE DRAWING FIGURES

DETAILED DESCRIPTION OF THE PREFERRED EMBODIMENT OF THE INVENTION

Other objects, features and advantages of the invention will become apparent from a consideration of the following detailed description and the accompanying drawings.

The hybrid arched overfilled bridge structure and method of construction embodying the present invention includes a concrete arch span with three major components: side elements, with one sector on each side of the arch formed of pre-cast side elements; and one sector located between the side elements formed of cast-in-place concrete. The concrete can be reinforced if desired.

Figure 1:
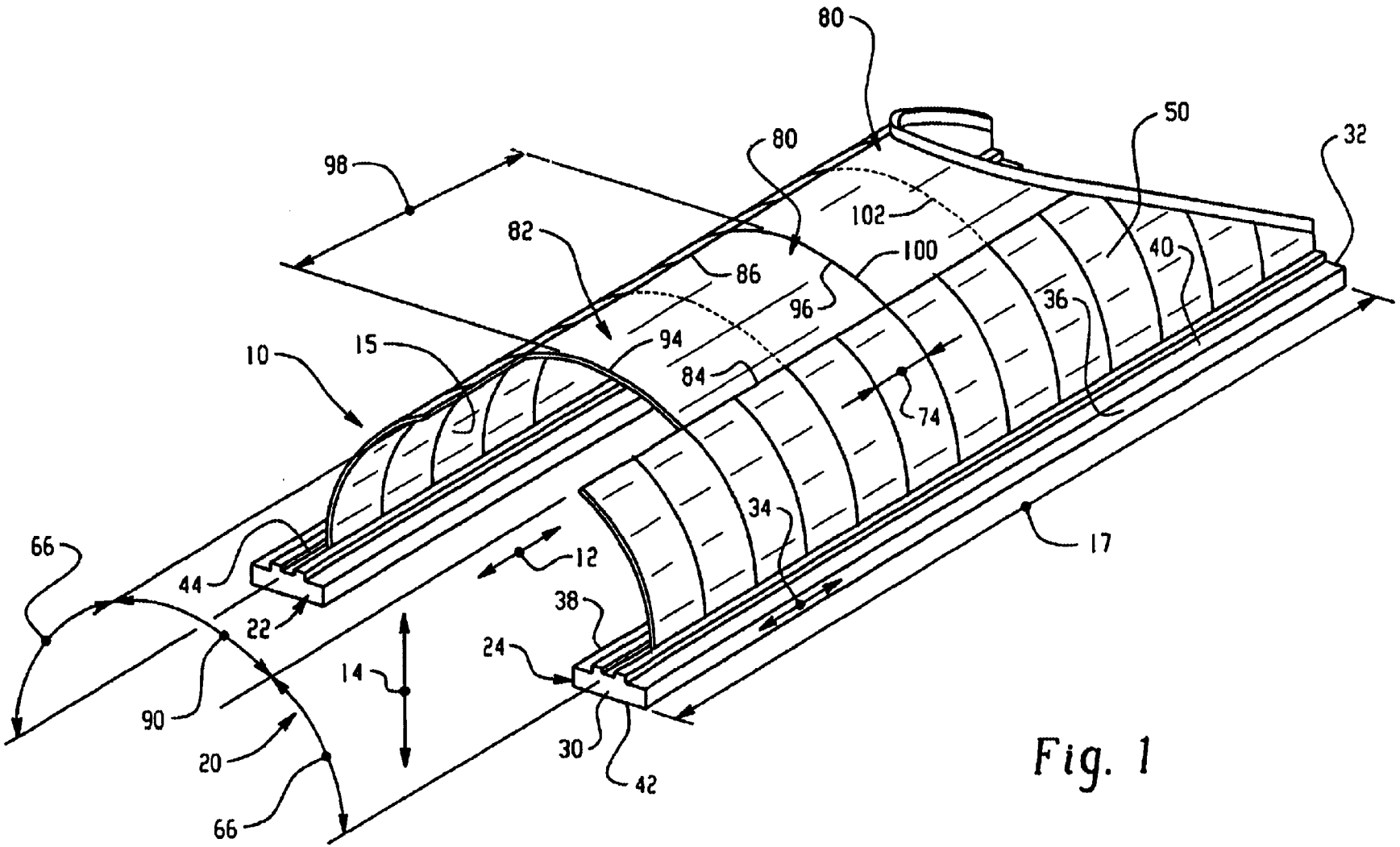
FIG. 1 is a perspective view of a hybrid arched overfilled bridge embodying the teaching of the present invention.
Figure 2:
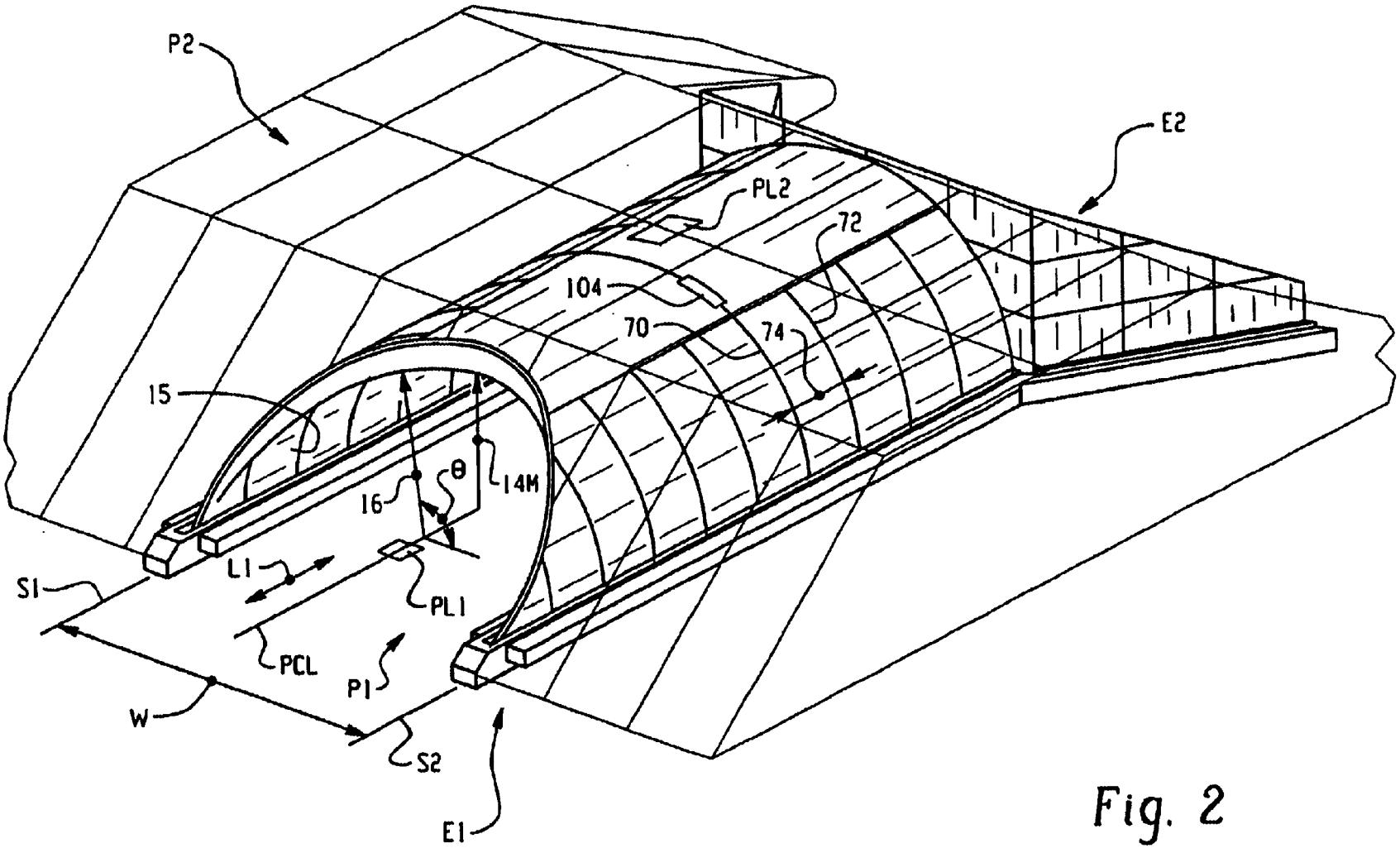
FIG. 2 is a perspective view of a hybrid arched overfilled bridge with a battered slope end treatment.
Figure 3:
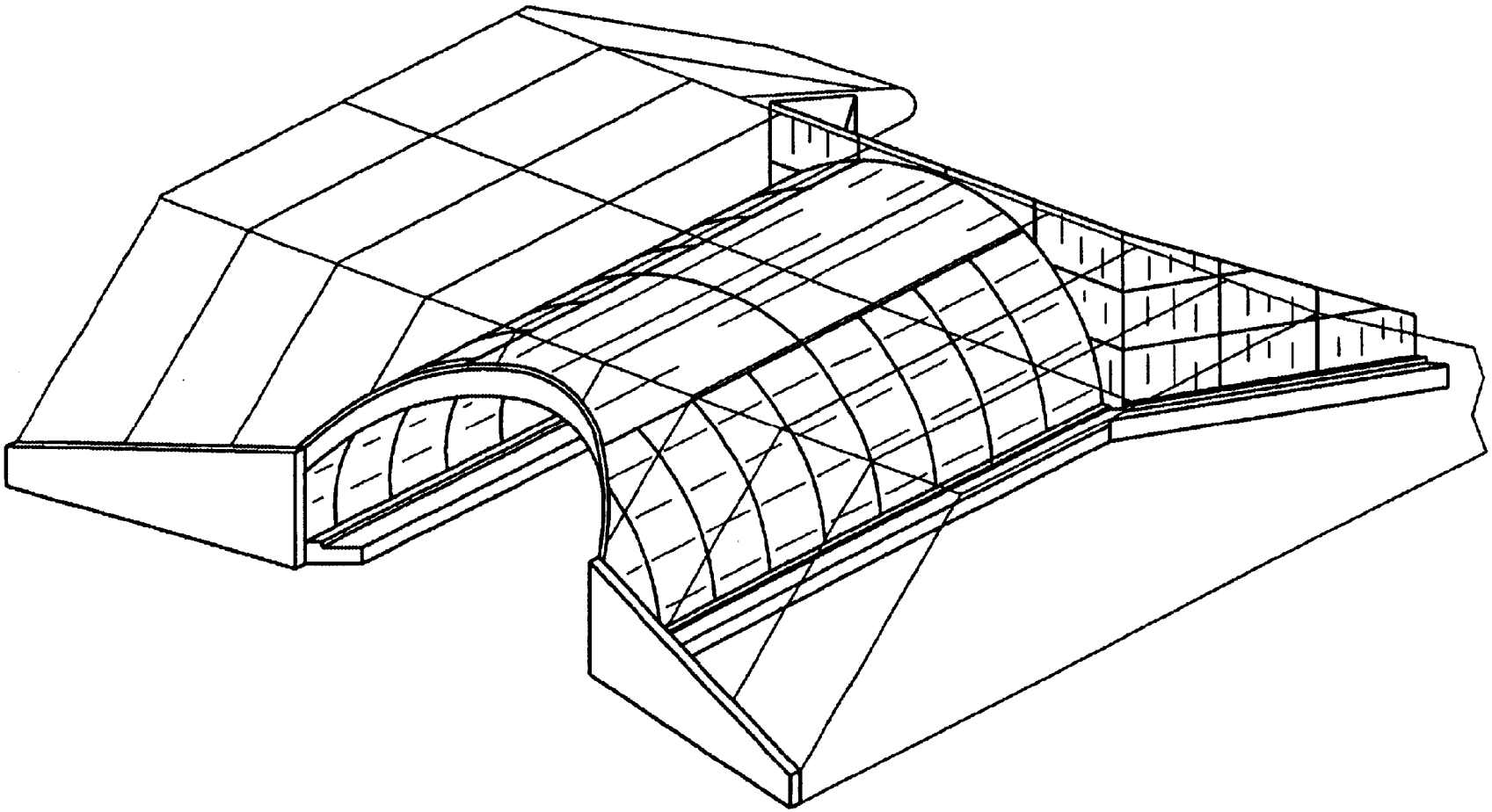
FIG. 3 is a perspective view of a hybrid arched overfilled bridge with a wing wall end treatment.

Shown in FIGS. 1–5 is a hybrid arched overfilled bridge structure 10 of the present invention. As can be seen in FIGS. 2 and 3, the bridge structure is associated with a first pathway P1 that is located at one level in a vertical plane and supports a second pathway P2 above that first pathway. Examples of the pathways include roadways, footpaths, waterways, railroad right-of-ways, finished and unfinished paths, and the like as is well known in the bridge art. The bridge structure of the present invention is an overfilled structure, that is, backfill will be used to support the elements of the structure as discussed in the incorporated documents. The bridge structure described in the present invention may also be used to create an underground cavern suitable for storage, human occupation, shelter or other purposes for which the creation of an underground space may be used. Similarly, pathway P2 described above may instead be utilized as an open area or other free space, or in less frequent applications, even built upon.

Bridge structure 10 includes an overall width dimension W measured from a first side edge S1 of first pathway P1 to a second side edge S2 of first pathway P1 when bridge structure 10 is in a set up configuration. First pathway P1 has a lengthwise dimension L1 extending in the direction of first and second side edges S1 and S2, and first pathway P1 includes a centerline PCL located midway between first and second side edges S1 and S2 of first pathway P1 and extends along lengthwise direction L1 of first pathway P1. For purposes of reader orientation, it is noted that first pathway P1 contains a first plane PL1 containing a portion of lengthwise dimension L1 of first pathway P1. Pathway P1 can be rectilinear or curved.

As shown in FIG. 1, bridge structure 10 includes a running length dimension 12 measured along lengthwise dimension L1 of first pathway P1. Bridge structure 10 further includes an overall height dimension 14 in the set-up configuration measured from first plane PL1 in first pathway P1 to a second plane PL2 in the bridge structure adjacent to second pathway P2 with second plane PL2 being spaced apart from first plane PL1 in first pathway P2. Preferably, second plane PL2 is located on an inside surface 15 of bridge structure 10; but plane PL2 could be located in any other location that is convenient for calculations and analysis without departing from the scope of the present disclosure; therefore, planes PL1 and PL2 can be located anywhere, and are shown in FIG. 2 for the sake of explanation and are not intended to be limiting. Overall height dimension 14 includes a maximum overall height dimension as will be understood from the teaching of this disclosure. As shown in the bridge structure illustrated in FIG. 2, maximum overall height dimension 14M is located near centerline PCL of first pathway P1.

Bridge structure 10 includes a widthwise shape that is arcuate in the set-up configuration and has a radius of curvature defined by a unit radian 16 extending from first pathway P1 toward second pathway P2 in the set-up configuration of bridge structure 10. The overall curvature of the bridge structure is defined as unit radian 16 moves in a vertical plane through an angle of approximately ↑radians (180°) with the instantaneous curvature being defined at any particular location according to unit radian 16, and can be a compound curvature if suitable. Bridge structure 10 further includes an overall arc length 20 in the set-up configuration which corresponds to the radius of curvature as defined by unit radian 16 at any particular location, overall width dimension W and overall height dimension 14. As will be understood by those skilled in the art, arc length 20 is a function of the radius of curvature R and the included angle θ traversed by unit radian 16, that is arc length is a function of Rθ, with θ being measured in radians. As the radius of curvature normally varies as the unit radian moves through angle θ so the overall arc length of bridge structure will be an arithmetic sum of a plurality of arc lengths each determined as discussed above.

Bridge structure 10 further includes first and second end treatments E1 and E2 respectively, with each end treatment located adjacent to an end of running length dimension 12 in the set-up configuration of the bridge structure. Bridge structure 10 thus has an overall length dimension 17 measured along running length dimension 12 between end treatments E1 and E2. The end treatments can be any of a wide variety of shapes and components, and two such end treatments are shown in FIGS. 2 and 3, with FIG. 2 showing a battered slope end treatment and FIG. 3 showing a wing wall end treatment. As indicated in FIG. 2, a spandrel wall can also be included as can a mechanically stabilized earth wall. Other end treatments can be used as will occur to those skilled in the art based on the teaching of this disclosure. Accordingly, such additional end treatments are intended to be covered in this disclosure as well. It is noted that the ends of the bridge structure can either be cut off along a sloping plane of an embankment, with or without wing walls on the lower slope of the embankment or the embankment can be perpendicular or skewed to the centerline of the bridge structure, or the end treatments can be normally curtailed with mechanically stabilized earth walls or spandrel or wing walls.

As shown in FIG. 1, bridge structure 10 further includes first and second footing strips 22 and 24. Each footing strip is located adjacent to first and second side edges S1 and S2 of first pathway P1 respectively in the set-up configuration of the bridge structure. Each footing strip includes two ends 30 and 32, a length dimension 34 extending between ends 30 and 32 of each footing strip, with length dimension 34 corresponding to overall length dimension 17, first and second sides 36 and 38 extending along length dimension 34 of each footing strip, a top surface 40, a bottom surface 42 resting on the ground adjacent to first pathway P1, and a channel 44 defined in top surface 40 of each footing strip in the set-up configuration of the bridge structure. Channel 44 extends along length dimension 34 of each footing strip. Footing strips 22 and 24 are formed in a manner known to those skilled in the art and thus the formation and placement of the footing strips will not be discussed.

Figure 5:
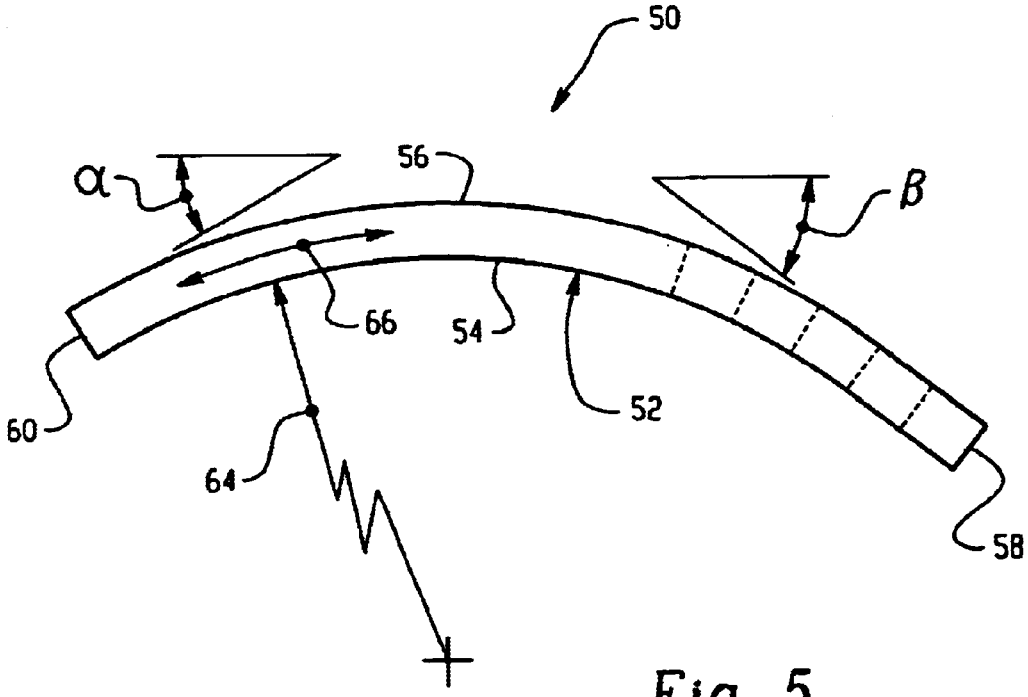
FIG. 5 is a view of a side element.

Bridge structure 10 further includes a plurality of side elements, such as side element 50. As shown in FIGS. 1 and 5, each side element 50 includes an arcuate body 52, having an inside surface 54 and an outside surface 56 in the set-up configuration of the bridge structure, a first end 58 on body 52 of each side element 50 which is received in one of the channels 44 in the set-up configuration of the bridge structure, a second end 60 on body 52 of each side element 50 which is spaced from first end 58 of body 52 of each side element 50 with the arcuate body 52 of each side element in the set-up configuration extending from the channel which receives first end 56 of side element 50 toward second plane PL2 in second pathway P2 whereby second end 60 of each side element 50 in the set-up configuration of the bridge structure is located between the channel receiving the first end of each side element and the second pathway. In the set-up configuration, inside surface 54 of each side element forms a portion of inside surface 15 of bridge structure 10.

Each side element is arcuate and includes a radius of curvature defined by a unit radian 64 of each side element. As discussed above, while one form of the bridge structure includes a uniform curvature for each side element, a compound curvature is also possible without departing from the scope of the present disclosure. Each side element further includes a side element arc length 66 which corresponds to radius of curvature of the body of each side element and extends from first end 58 on body 52 of each side element 50 to second end 60 on body 52 of each side element 50. As discussed above, the arc length of each side element is a function of the radius of curvature of the side element body and the angular extent of the body.

As can be understood from FIGS. 1–4, arc length 66 of body 52 of each side element 50 in the set-up configuration of the bridge structure is smaller than overall arc length 20 of the bridge structure. In one form of bridge structure 10, the arc length of arc 66 is approximately one-third of the overall arc length 20 of the bridge structure. As shown in FIG. 2, each side element 50 further includes two sides 70 and 72 which are spaced apart from each other along running length dimension 12 in the set-up configuration of the bridge structure and a length dimension 74 of the body of each side element 50 measured between two sides 70 and 72 of body 52 of each side element 50 along running length dimension 12 in the set-up configuration of the bridge structure. As can be understood from FIGS. 1–4, length dimension 74 of the body of each side element 50 is smaller than overall length dimension 17.

As can be understood from FIGS. 6–9, each side element 50 includes a connecting element 76, such as a bar or the like,. on second end 60 of body 52 of each side element 50 which extends away from second end 60 of the body of each side element. The function and operation of connecting element 76 will be understood from the following disclosure. Such connections are generally formed by a continuation of reinforcement steel in a side element, which is subsequently overlapped by steel placed for construction of the crown sector thus forming a structurally continuous reinforcement between these connected elements. This same method is applied in connecting adjacent crown sector elements.

Each side element of the plurality of side elements is pre-cast before it is placed in the set-up configuration of the bridge structure. The pre-casting process will be discussed below.

Bridge structure 10 further includes a plurality of crown sector elements, such as crown sector elements 80 shown in FIG. 1. Each crown sector element 80 includes an arcuate body 82, a first end 84 on the body of each crown sector element 80 which is oriented to extend along running length dimension 12 in the set-up-configuration of the bridge structure, a second end 86 on body 82 of each crown sector element 80 and which is spaced from first end 84 of body 82 of each crown sector element 80. As can be understood from FIGS. 1–4, the body 82 of each crown sector element 80 is curved and has a radius of curvature defined by unit radian 88 and a crown sector element arc length 90 which corresponds to radius of curvature of body 82 of each crown sector element 80 and extends from first end 84 of body 82 of each crown sector element 80 to second end 86 of body 82 of each crown sector element 80 in the set-up configuration of the bridge structure. As can be seen in FIG. 1, overall arc length 20 is comprised of a sum of the arc lengths 66 of two side elements plus the arc length 90 of the crown sector element located between the two side elements of interest. In one form of the bridge structure, arc length 90 is approximately one-third of the overall arc length 20 of the bridge structure and arc length 66 of each side element associated with the crown sector element is also approximately one-third of the overall arc length 20. However, other fractions of the overall arc length can be used without departing from the scope of the present disclosure.

Body 82 of each crown sector element 80 further includes two sides 94 and 96 which are spaced apart from each other along running length dimension 12 in the set-up configuration of the bridge structure, and a length dimension 98 of body 82 of each crown sector element 80 is measured between the two sides 94 and 96 of body 82 of each crown sector element 80. Length dimension 98 of body 82 of each crown sector element 80 is equal to or smaller than overall length dimension 17 of bridge structure 10 in the set-up configuration of bridge structure 10. The overall length of bridge structure 10 is generally made up of a multiple of length dimensions 98 of bodies 82 of crown sector elements 80, with some adjustment made at each end of the bridge structure to account for the shapes of end treatments E1 and E2. Furthermore, length dimension 98 of body 82 of each crown sector element 80 is equal to or greater than length dimension 74 of body 52 of each side element 50. Length dimension 98 of body 82 of crown sector element 80 is normally a multiple of length dimension 74 of body 52 of each side element 50.

Each crown sector element 80 of the plurality of crown sector element is cast-in-place after at least some of the side elements 50 have been placed in the set-up configuration. Thus, the set-up bridge structure is a hybrid which includes pre-cast side elements and cast-in-place crown sector elements.

Figure 4:
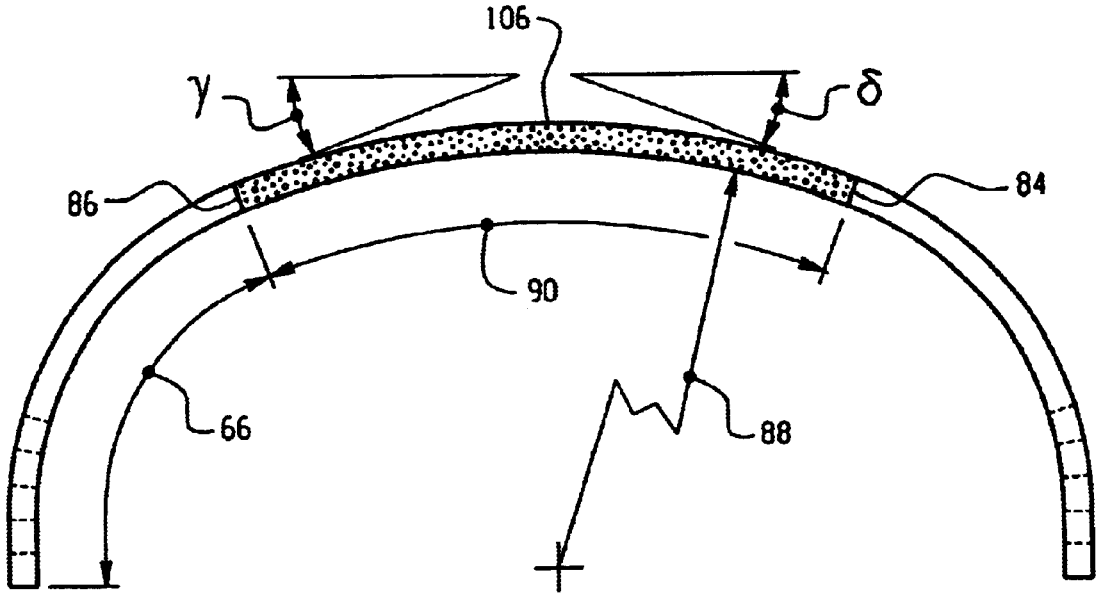
FIG. 4 is an end elevational view of a hybrid arched overfilled bridge illustrating the relationship of side elements to a crown sector section.

It is noted that the crown sector elements can be cast on site, in place, with the attendant advantages. It is also noted that the crown sector elements pass through an arc such that the gradient of the arc is always less than the castable gradient of the concrete mix being used for the bridge construction. The gradient is illustrated in FIG. 4 by tangential angles $\gamma$ and $\delta$, with one form of the bridge having these angles between 20° and 30°. Furthermore, the side elements can be cast in a factory and shipped to the site, or pre-cast on site, and have tangential angles $\alpha$ and $\beta$ that may or may not have the same constraints as above discussed. It has been found that angles $\alpha$ and $\beta$ can be between 20° and 30° or can be greater than 30° under some circumstances. It is noted that the signifigance of the tangential angles is their steepness with respect to horizontal. A key point is that concrete cannot be cast at a gradient of more than about 20° to about 30° (depending on the concrete type) without a form on top of the concrete to hold it in place.

In order to minimize the arc length of the side elements, the span of the crown sector can be chosen as the maximum possible without exceeding the aforementioned gradients. As some reinforced concrete arch bridges do not pass through an arch of more than 180°, and given that appropriate concrete mixes, such as low slump concrete mix, can be produced that enable placement and compaction of up to a 30° gradient; casting the crown at a slope of 30° gradient results in side elements which can also be cast without counter forms. The length dimension 74 of body 52 of each side elment 50 is determined by practical and economical considerations, including weight of the elements as dictated by the equipment available on the construction site for lifting and placing such elements. When cast on site, the length dimension 74 of body 52 of each side element 50 may be relatively long. When cast off site, the length dimension 74 of body 52 of each side element 50 is limited by transportation requirements. Standard length dimension 74 will be chosen for the body 52 of each side element 50 for each arch type such that a multiple of side elements match both the length dimension 98 of body 82 of crown sector element 80 as well as other considerations associated with the bridge structure. The length dimension 98 of body 82 of crown sector element 80 is determined to ensure a practical construction sequence, as each individual crown sector element 80 of overfilled bridge structure 10 is produced in one distinct construction stage, and the concrete in each element placed and allowed to harden ("cast") prior to the construction of the next element. For conventional bridge lengths, the length dimension 98 of body 82 of crown sector element 80 is normally in the order of 10 m to 12 m. Experience shows that this length is the practical concrete casting length for similar shell forms. The ends adjacent to end treatments E1 and E2 of overfilled brdiges structure 10 can be formed to comply with the shapes associated with those end treatments during the casting of the adjacent crown sector elements.

The interfaces at sides 94 and 96, between adjacent crown sector elements 80 are formed by cold joints which may or may not be continuously reinforced. The cast-in-place crown sector, formed by a series of crown sector elements 80 is thus a continuous element once completed. In order to control shrinkage cracking within the case-in-place crown sector, shrinkage joint 102, which may or may not be continuously reinforced, is to be formed in crown sector elements 80 at regular intervals along running length dimension 12. The spacing of shrinkage joints 102 is normally determined such that shrinkage joints 102 divide crown sector element 80 into even intervals. One form of the bridge structure includes shrinkage joints every 4 m to 6 m. The location along running length 12 of shrinkage joints 102 is also normally determined such that they may occur at a location along the running length 12 of sides 70 and 72 of side elements 50. Beveled edges may or may not be applied to all aformentioned edges and joints of crown sector elements 80 and side elements 50.

Waterproofing of the overfilled bridge structure 10 may be facilitated by either the placement of waterproofing elements, such as sealing strips, such as sealing strip 104 shown in FIG. 2, along the outside face of all aforementioned edges and joints, or by the application of a membrane to the outside surfaces 106 and 56 of crown sector elements 80 and side elements 50 respectively, or by a combination of these two treatments. Waterproofing elements are placed across the gaps between side elements and at the locations of shrinkage joints and construction joints as water may easily seep through the gaps and induce cracks at these locations. Alternative means of waterproofing the structure may be the application of waterproof membrane to the outside of the structure or some form of chemical treatment or some combination thereof.

As can be understood from the foregoing, the connecting elements 76 (see FIGS. 6–9) will extend into the concrete mix during the casting in place of the crown sector elements. Once the crown concrete mix has hardened, the crown sector will be locked to the side elements via the abutting contact between the crown sector and the side elements as well as due to the locking created by the connecting elements.

Figure 6:
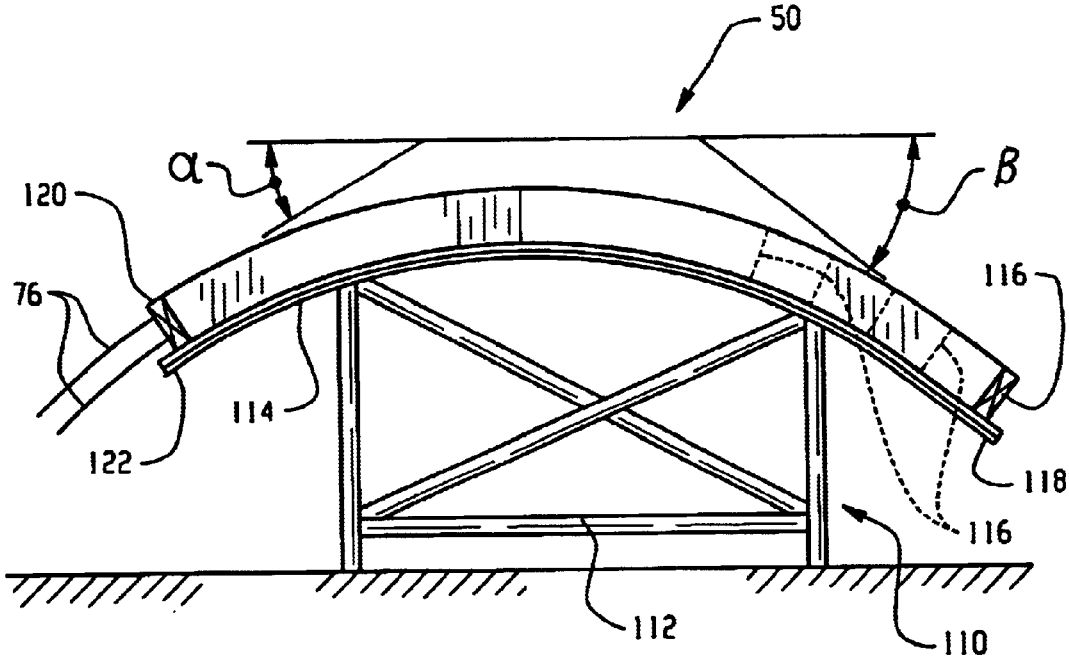
FIG. 6 is a side view of a casting table used to pre-cast a side element.
Figure 7:
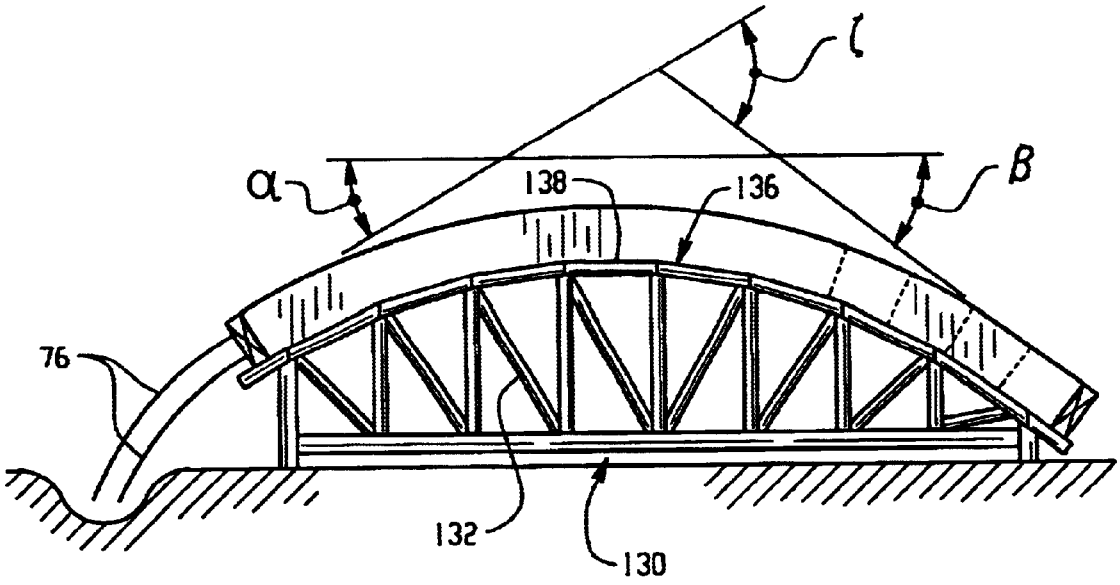
FIG. 7 is a side view of another form of casting table.

Referring to FIGS. 6–9, the means and method for precasting the side elements can be understood. The side elements can be cast in a horizontal orientation and then elevated into the orientation shown in FIGS. 1–4. A first form of casting table is shown in FIG. 6 as casting table 110 which includes a support structure 112 and an arcuate form surface 114, with an adjustable end element 116 on one end 118 of form surface 114 and another end element 120 on end 122 of form surface 114. A side element 50 is shown in place on form surface 114. A casting table 130 is shown in FIG. 7 which has a support structure 132 and an arcuate form surface 136 that is formed of a plurality of flat panels, such as panel 138. Casting tables 110 and 130 are used when the angles α and β are less than the concrete mix castable gradient, nominally about 30°. Casting tables 110 and 130, and form surfaces 114 (curved) and 136 (flat panels) are inidicative only and may be used interchangeably or with other table or form types without departing from the scope of the present disclosure. A counter form can be used with the casting table to enable casting of the concrete at angles steeper than the castable gradient of the concrete without support.

Figure 8:
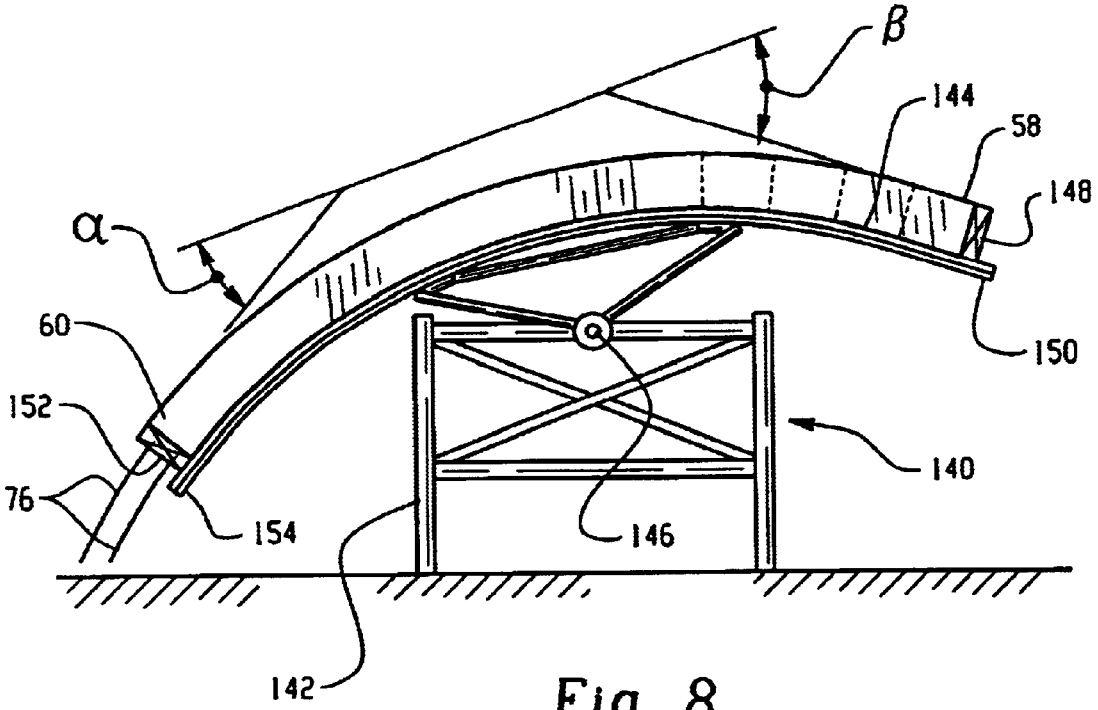
FIG. 8 is a side view of a pivoting casting table used to form a pre-cast side element.
Figure 9:
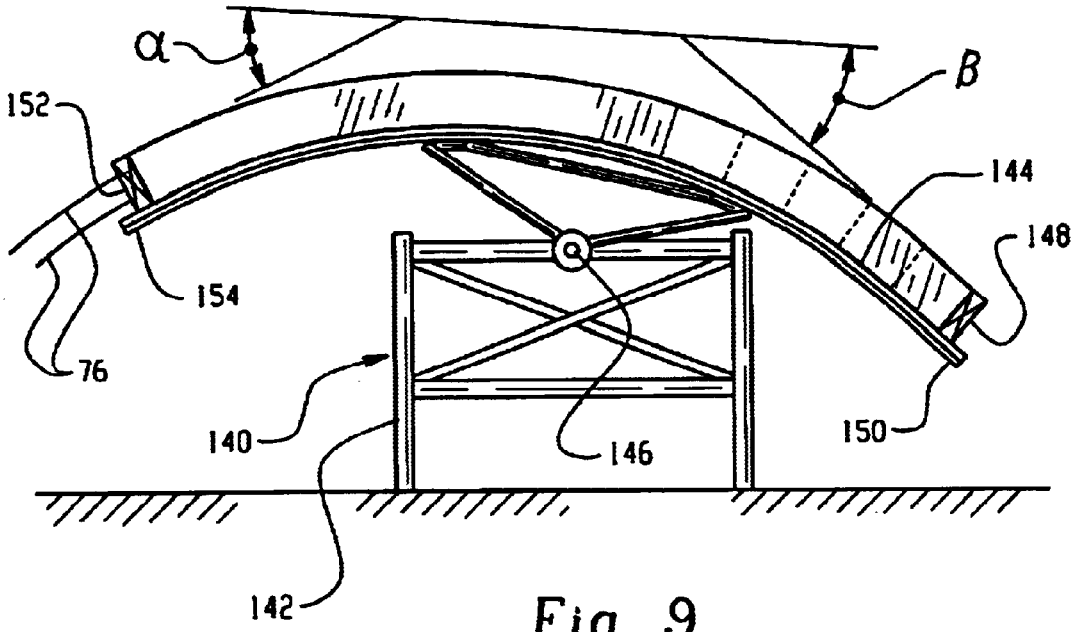
FIG. 9 is another view of the pivoting casting table shown in FIG. 8.

In the situation where the average of angles α and β is more than the concrete mix castable gradient, special casting tables can be used to pre-cast the side elements. Shown in FIGS. 8 and 9 is a pivoting casting table 140 which includes a support structure 142 and an arcuate form surface 144 pivotally mounted on the support structure 142 by a pivot connection 146 to pivot between a first position shown in FIG. 8 and a second position shown in FIG. 9. Casting table 140 includes an end element 148 near end 150 thereof and an end element 152 near end 154 thereof. A concrete mix is poured onto form surface 144, and is then permitted to harden. In FIG. 8, the angle of one end is less than the concrete mix castable gradient, and in FIG. 9 the angle of the other end is less than the concrete mix castable gradient. It is noted that the end 58 is the first cast end and end 60 is the second cast end. It is also noted that the side element casting tables and form surfaces can be adjusted to enable pouring of different arch sub-types without departing from the scope of the present invention.

As shown in FIG. 7, an exterior angle δ of between 40° and 60° can be established.

Figure 10:
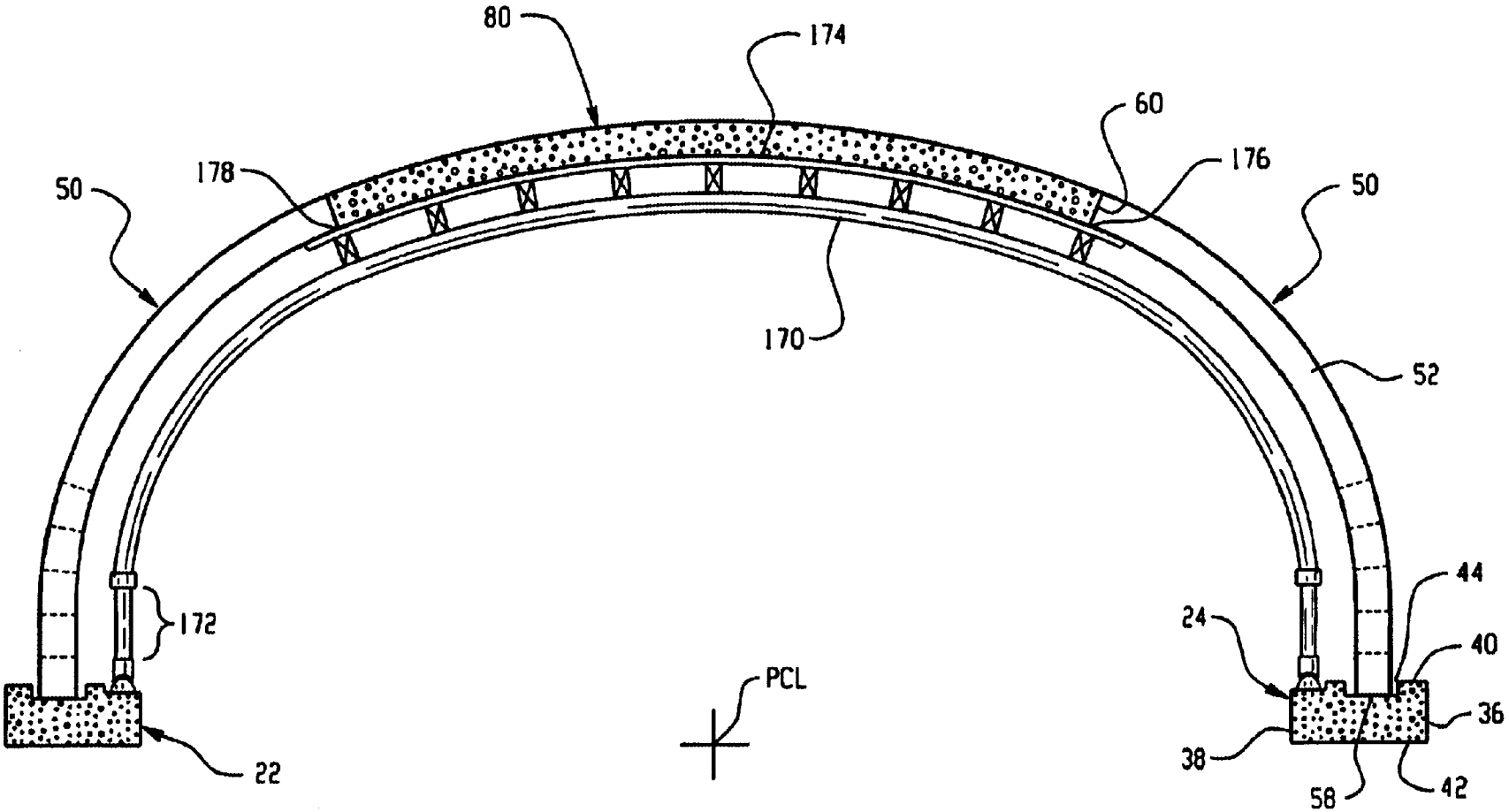
FIG. 10 is a view showing the form used to cast in place the crown sector element of the bridge of the present invention.

Shown in FIG. 10 is a form support or frame 170 which is used during the casting in place of the crown sector elements 80 of bridge structure 10. Mounted on support form support 170 is form surface 174. Frame 170 may include an arch or truss or any other kind of stable structure suitable for supporting form surfce 174 for the purpose of casting crown sector element 80. As can be seen in FIG. 10, frame 170 can be supported on upper surfaces 40 of footing strips 22 and 24 near side 38 of each footing strip. Frame 170 may include such elements as jack legs and rollers 172 to make the position of the frame and form surface adjustable and to enable translation of the frame and form surface along the direction of length dimension 12 of overfilled bridge structure 10 such that sequential crown sector elements may be formed on the same frame and form surface.

In order to construct each crown sector element 80, frame 170 is first located such that form surface 174 is in the correct position. Precast side elements 50 are placed against each side of form surface 174 with ends 58 of the side elements accommodated in channels 44 of footing strips 22 and 24. Ends 60 of side elements 50 are located above the footing strips, and due to the curvature of bodies 52 of side elements 50, ends 60 are positioned toward centerline PCL of the bridge structure 10 when the side elements are in the set-up configuration. The contact between ends 60 of side elements 50 and the form surface 174 includes seals 176 and 178 to prevent loss of concrete from within the form during casting of the crown sector element 80. A crown sector element 80 is cast onto the form surface 174 to close the arch between the positioned side elements 50. The side elements 50 are supported by the form surface 174 during the placement and crown sector casting process.

Conventional methods such as immersion, float or form vibrators or the like can be used to compact the placed concrete.

Frame 170 can be constructed of metal, reinforced concrete, timber or a combination thereof as suitable. Frame 170 can be easily set up into the FIG. 10 configuration, demounted after use, and then re-assembled as needed. Frame 170 may be formed of a truss system or of a pre-cast re-inforced concrete arch shaped to follow (at a smaller radius) the innner profile of the bridge structure arch.

Subject to system optimization, the crown form surface 174 and supporting frame 170 may be made generally applicable to several arch types to enable re-use of the same frame and formwork for several projects. To enable this, the form surface may be adjustable to different radial profiles, different arch lengths, and different frame heights. The form and frame should be re-usable and de-mountable to enable transportation to other construction sites. Material used in the crown sector form surface 174 could be either curved or paneled and made of timber, steel, or concrete plates, or any appropriate system of joinable panels. The joints in abutting form panels are formed to ensure a good concrete finish and are adjustable to enable their use for various profile radii. It is also noted that the connecting elements 76 are normally detailed to ensure proper connection between side elements 50 and the cast-in-place crown sector elements 80.

Figure 11:
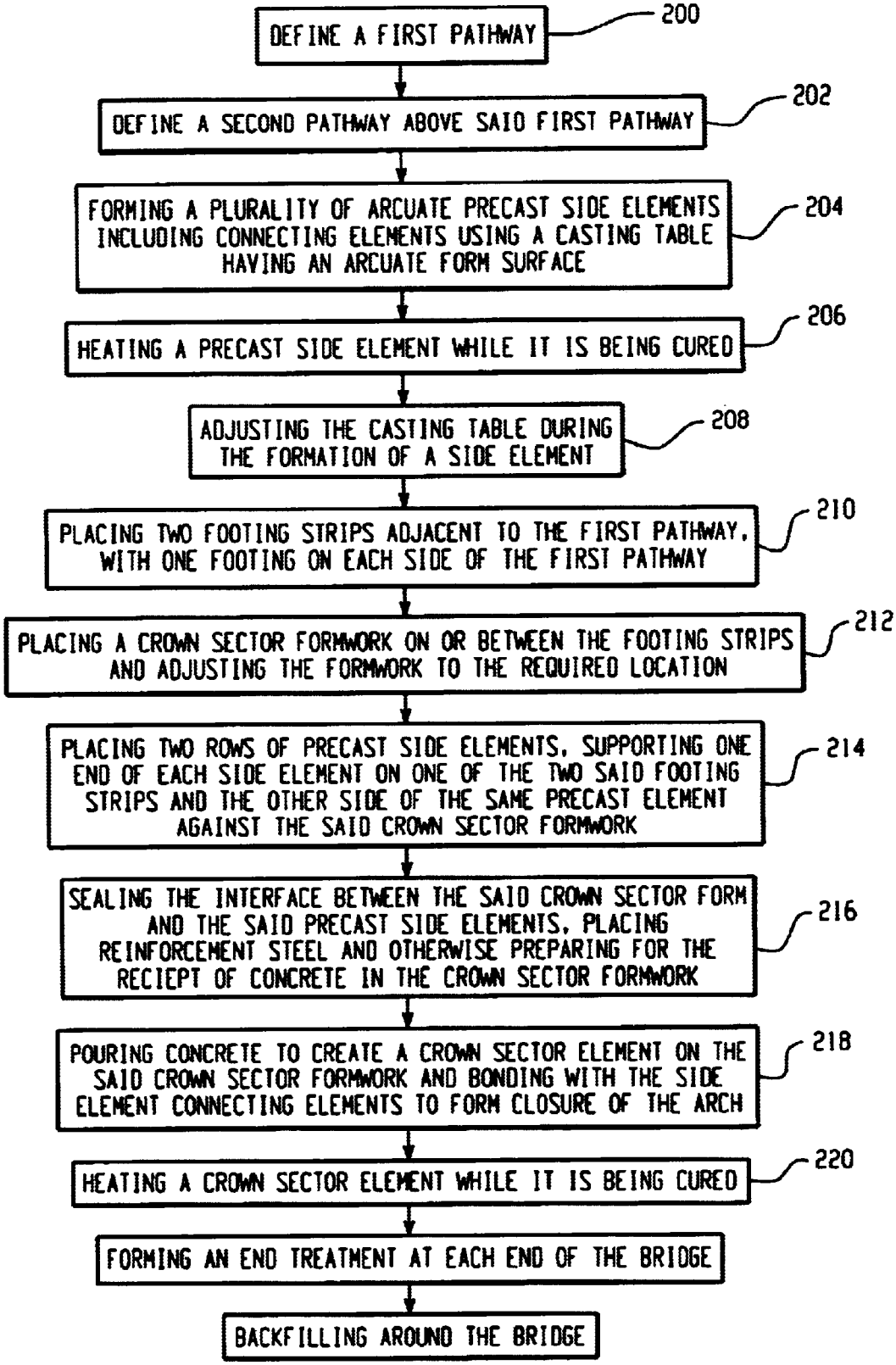
FIG. 11 is a flow chart illustrating the method of erecting a hybrid arched overfilled bridge embodying the teaching of the present invention.

Referring to FIG. 11, the method embodying the present invention is shown. As shown in FIG. 11, the method of forming a hybrid arched overfilled bridge structure of the present invention comprises steps of defining a first pathway in step 200; defining a second pathway spaced above the first pathway in step 202; forming a plurality of arcuate pre-cast side elements including connecting elements using a casting table having an arcuate form surface in step 204; if necessary, heating a pre-cast side element while it is being cured in step 206; if necessary adjusting the casting table during the formation of a side element in step 208; placing two footing strips adjacent to the first pathway in step 210, with one footing strip being located on each side of the first pathway; placing a crown sector formwork (frame and form surface) on or between the footing strips and adjusting the formwork to the required location and shape of the overfilled bridge structure in step 212; placing two rows of pre-cast side elements in step 214; supporting one end of each of the pre-cast side elements on one of the footing strips of step 210 and the other against the crown sector formwork of step 212, such that each pre-cast side element extends from the footing strip toward the second pathway and partially over the first pathway with the connecting element extending over the first pathway; sealing ends of the crown sector form and placing crown sector steel reinforcement above the crown sector formwork in step 216; pouring a concrete mix onto the crown sector formwork, thus embedding the connecting elements and the crown sector steel reinforcement to form the closure of the arch between the two rows of side elements in step 218; if necessary, heating the concrete mix on the crown sector form during curing in step 220.

It is anticipated that the just-described method could be achieved in a 24-hour turnaround period. To this end, heating elements included in the various elements ensure curing temperature is high enough in the cast-in-place crown sector elements, especially during cold weather. The above-described cycle is repeated several times as necessary to complete the required length of bridge structure. At each end of the structure, the crown sector and side elements are formed such that their geometry matches that of the chosen bridge end treatment.

The overfilled bridge structure is completed by backfiling of the bridge structure. This backfiling operation may progress at completed sections of the bridge structure while other sections of the bridge structure are being constructed.

A construction crane may be required on the construction site to place the various elements discussed above. The pre-casting and casting in place permits these elements to be within the limits of the crane.

The above disclosure has been directed to a rectilinear bridge structure; however, the above-disclosed means and methods can be applied to curved or angular shapes as well without departing from the scope of the present disclosure.

It is understood that while certain forms of the present invention have been illustrated and described herein, it is not to be limited to the specific forms or arrangements of parts described and shown.

What is claimed is:

1. A hybrid arched overfilled bridge structure comprising:

A) an overall arc length;

B) an overall running length;

C) a plurality of arcuate pre-cast side elements, each side element including (1) a running length extending in the direction of said overall running length and being smaller than said overall running length, and (2) an arc length extending in the direction of said overall arc length and being smaller than said overall arc length; and D) an arcuate cast-in-place crown sector element connecting two side elements together and which includes (1) a running length extending in the direction of said overall running length and being smaller than said overall running length, (2) an arc length extending in the direction of said overall arc length and being smaller than said overall arc length; and E) ends on said overall running length and an end treatment at each end of said overall running length.

2. The hybrid arched overfilled bridge structure defined in claim 1 further including a plurality of cast-in-place crown sector elements, each having a running length smaller than said overall running length.

3. The hybrid arched overfilled bridge structure defined in claim 2 wherein the running length of each crown sector element is at least equal to the running length of each side element.

4. The hybrid arched overfilled bridge structure defined in claim 2 further including joints between adjacent crown sector elements.

5. The hybrid arched overfilled bridge structure defined in claim 1 wherein each side element has a tangential angle such that a gradient of no more than about 20° to 30° is established when the side element is laid flat.

6. The hybrid arched overfilled bridge structure defined in claim 1 wherein each side element has a tangential angle such that a gradient of more than 30° is established when the side element is laid flat.

7. The hybrid arched overfilled bridge structure defined in claim 1 wherein each side element includes a connecting element that protrudes into said cast-in-place crown sector element to connect the side element to said cast-in-place crown sector element.

8. The hybrid arched overfilled bridge structure defined in claim 1 further including waterproofing elements on said crown sector element.

9. The hybrid arched overfilled bridge structure defined in claim 2 wherein said plurality of cast-in-place crown sector elements form a continuous structure along said overall running length.

10. The hybrid arched overfilled bridge structure defined in claim 1 wherein said end treatment includes a spandrel wall.

11. The hybrid arched overfilled bridge structure defined in claim 1 further including steel reinforcement elements in said cast-in-place crown sector element.

12. The hybrid arched overfilled bridge structure defined in claim 1 further including a footing structure.

13. The hybrid arched overfilled bridge structure defined in claim 1 wherein said end treatment includes a wing wall.

14. The hybrid arched overfilled bridge structure defined in claim 1 wherein said end treatment includes a battered slope to which the end of the structure conforms.

15. A hybrid arched overfilled bridge structure comprising:

E) an overall width dimension measured from a first side edge of a first pathway to a second side edge of the first pathway in a set up configuration with the first pathway having a lengthwise dimension extending in the direction of the first and second side edges, the first pathway including a centerline located midway between the first and second side edges of the first pathway and extending along the lengthwise direction of the first pathway, a first plane containing a portion of the lengthwise dimension of the first pathway;

F) a running length dimension measured along the lengthwise dimension of the first pathway;

G) an overall height dimension in the set-up configuration measured from the first plane in the first pathway to a second plane adjacent to a second pathway with the second plane in the second pathway being spaced apart from the first plane in the first pathway, said overall height dimension including a maximum overall height dimension;

H) a widthwise shape that is arcuate in the set-up configuration and has a radius of curvature extending from the first pathway toward the second pathway in the set-up configuration and an overall arc length in the set-up configuration corresponding to the radius of curvature, said overall width dimension and said overall height dimension;

I) first and second end treatments, with each end treatment located adjacent to an end of said running length dimension in the set-up configuration;

J) first and second footing strips, each footing strip located adjacent to the first and second side edges of the first pathway respectively in the set-up configuration, each footing strip including (1) two ends, (2) a length dimension extending between the two ends of each footing strip, (3) first and second sides extending along the length dimension of each footing strip, (4) a top surface, and (5) a channel defined in the top surface of each footing strip in the set-up configuration and extending along the length dimension of each footing strip;

K) a plurality of side elements, each side element including (1) an arcuate body, (2) a first end on the body of each side element which is received in one of the channels in the set-up configuration, (3) a second end on the body of each side element which is spaced from the first end of the body of each side element with the arcuate body of each side element in the set-up configuration extending from the channel which receives the first end of the side element toward the second plane in the second pathway whereby the second end of each side element in the set-up configuration is located between the channel receiving the first end of each side element and the second pathway, (4) a radius of curvature of the body of each side element, (5) a side element arc length which corresponds to the radius of curvature of the body of each side element and extends from the first end on the body of each side element to the second end on the body of each side element, (6) the arc length of the body of each side element in the set-up configuration being smaller than said overall arc length, (7) two sides which are spaced apart from each other along said running length dimension in the set-up configuration, (8) a length dimension of the body of each side element measured between the two sides of the body of each side element along said running length dimension in the set-up configuration, (9) the length dimension of the body of each side element being smaller than said overall length dimension,

(10) a connecting element on the second end of the body of each side element and extending away from the second end of the body of each side element,

(11) each side element of said plurality of side elements being pre-cast before being placed in the set-up configuration; and L) a plurality of crown sector elements, each crown sector element including (1) an arcuate body, (2) a first end on the body of each crown sector element which is oriented to extend along said running length dimension in the set-up configuration, (3) a second end on the body of each crown sector element which is spaced from the first end of the body of each crown sector element, (4) a radius of curvature of the body of each crown sector element, (5) a crown sector element arc length which corresponds to the radius of curvature of the body of each crown sector element and extends from the first end of the body of each crown sector element to the second end of the body of each crown sector element in the set-up configuration, (6) the crown sector arc length of the body of each crown sector element being smaller than said overall arc length, (7) two sides of the body of each crown sector element which are spaced apart from each other along said running length dimension the set-up configuration, (8) a length dimension of the body of each crown sector element measured between the two sides of the body of each crown sector element, (9) the length dimension of the body of each crown sector element being smaller than said overall length dimension,

(10) the length dimension of the body of each crown sector element being at least equal to the length dimension of the body of each side element, and

(11) each crown sector element of said plurality of crown sector element being cast-in-place after at least some of said side elements have been placed in the set-up configuration.

16. The hybrid arched overfilled bridge structure defined in claim 15 wherein the first end of the body of each crown sector element abuts the second end of the body of one side element and the second end of the body of each crown sector element abuts the second end of the body of a second side element and the connecting element on the second side of the first and second side elements protrude into one of said plurality of cast-in-place crown sector elements in the set-up configuration.

17. The hybrid arched overfilled bridge structure defined in claim 16 wherein the arcuate body of each crown sector element has a tangential angle such that a gradient of no more than about 20° to 30° is established.

18. The hybrid arched overfilled bridge structure defined in claim 16, wherein the arcuate body of each crown sector element has a tangential angle such that a gradient of more than 30° is established.

19. The hybrid arched overfilled bridge structure defined in claim 15 further including crown sector cold joints.

20. The hybrid arched overfilled bridge structure defined in claim 18 further including crown sector shrinkage joints.

21. The hybrid arched overfilled bridge structure defined in claim 15, wherein a side element includes heating elements.

22. The hybrid arched overfilled bridge structure defined in claim 21 wherein a crown sector element includes heating elements.

23. The hybrid arched overfilled bridge structure defined in claim 15 wherein each crown sector element further includes reinforcing elements.

* * * * *